US005954562A

United States Patent [19]

Chen

[11] Patent Number: 5,954,562

[45] Date of Patent: Sep. 21, 1999

[54] BUILDING BLOCK ASSEMBLY

[76] Inventor: Chen-Yao Chen, No.53. Shyr Jiann Street, Yuan Lin Town, Chang Hua Hsien, Taiwan

[21] Appl. No.: 09/110,157

[22] Filed: Jul. 6, 1998

[51] Int. Cl.[6] ..... A63H 33/10

[52] U.S. Cl. ..... 446/122; 446/118; 446/127; 446/103

[58] Field of Search ..... 446/85, 93, 94, 446/95, 105, 118, 122, 127, 103

[56] References Cited

U.S. PATENT DOCUMENTS

| | | | |
|---|---|---|---|
| 1,985,992 | 1/1935 | Hayman | 446/127 |
| 2,392,551 | 1/1946 | Roe . | |
| 3,603,053 | 9/1971 | Van Loghem . | |
| 3,987,579 | 10/1976 | Palenik, III | 446/118 |
| 4,035,977 | 7/1977 | Fischer . | |
| 4,052,832 | 10/1977 | Jungers . | |

FOREIGN PATENT DOCUMENTS

| | | | |
|---|---|---|---|
| 2305066 | 8/1974 | Germany | 446/122 |
| 2324413 | 12/1974 | Germany | 446/122 |
| 2224953 | 5/1990 | United Kingdom | 446/127 |
| 9219341 | 11/1992 | WIPO | 446/122 |

*Primary Examiner*—Kien T. Nguyen
*Assistant Examiner*—Jeffrey D. Carlson
*Attorney, Agent, or Firm*—Bacon & Thomas, PLLC

[57] ABSTRACT

Various constructions may be formed from a plurality of different geometric blocks having mortises formed therein for receiving correspondingly shaped connecting and axial rods which permit the blocks to be assembled in both longitudinal and transverse directions.

3 Claims, 3 Drawing Sheets

BUILDING BLOCK ASSEMBLY

BACKGROUND OF THE INVENTION (a) Field of the Invention

The present invention relates generally to a building block assembly, and more particularly to a building block assembly that employs connecting rods and axles rods to connect geometric blocks and wheels firmly or connect them to bases firmly so as to prevent the accomplished construction from falling apart and help sustain children's interest in playing.

(b) Description of the Prior Art

Building blocks and construction blocks are excellent educational toys for stimulating children's imagination while providing fun. Conventional building blocks, like Lego, are generally connected in a mortise and tenon joint. Depending on the size of the block, the upper side is provided with one or more tenons and the lower side has corresponding mortises. Children may use the blocks to build houses, castles, robots, ships, airplanes, etc. The blocks are directly connected to each other. In the other kind of construction blocks shaped like snow flakes, each piece is peripherally provided with equi-distant notches for engaging the notches of another piece, a central through hole, and a projection on one side for insertion into the through hole of another piece. Such construction blocks are also connected to each other directly. A major disadvantage of conventional building blocks is that they may easily become loosened or disengaged. As children like to play around with the things they have constructed, the construction may fall apart when hit, ruining their effort and interest in playing.

SUMMARY OF THE INVENTION

A primary object of the present invention is to provide a building block assembly which ensures firm connection of the blocks. According to this object of the present invention, the building block assembly comprises blocks of various geometric shapes, connecting rods of varying lengths and having a cross-shaped cross section, axle rods of varying lengths, wheels of different sizes, and bases. The geometric blocks are each provided with a longitudinal cross-shaped mortise for receiving the connecting rods or axle rods. The longitudinal planar sides of each block are provided with grooves having a substantially V-shaped cross section equivalent to one half of the cross-shaped mortise thereof such that one connecting rod may be used to connect two adjacent blocks when the latter are juxtaposed with their V-shaped grooves defining a complete cross-shaped hole for passage of the connecting rod. The connecting rods are insertable through the mortises of selected geometric blocks to connect them in a longitudinal direction or fitted into the grooves of adjacent geometric blocks to connect them in a transverse direction.

Another object of the present invention is to provide a building block assembly which enables the accomplished construction to roll along smoothly. According to this object of the present invention, each axle rod includes a connecting portion having a cross-shaped cross section, an axle portion of a reduced diameter connected to the connecting portion, and a stop rim at a distal end. Each wheel is centrally provided with a longitudinal receiving hole having a cross-shaped cross section. The axle rods may be inserted through the receiving holes of the wheels with the stop rims limiting the wheels and further into the mortises of the geometric blocks to allow the wheels to rotate smoothly so that the accomplished construction can be pushed along by means of the wheels.

A further object of the present invention is to provide a building block assembly which ensures that the accomplished construction will not easily fall apart. According to this object of the present invention, the bases are each provided with a plurality of cross-shaped mortises into which the connecting rods or axle rods may be inserted. The geometric blocks and wheels can be assembled to the bases by means of the connecting rods and axle rods. The connecting rods and axle rods ensure that the blocks and wheels are firmly connected to the bases.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
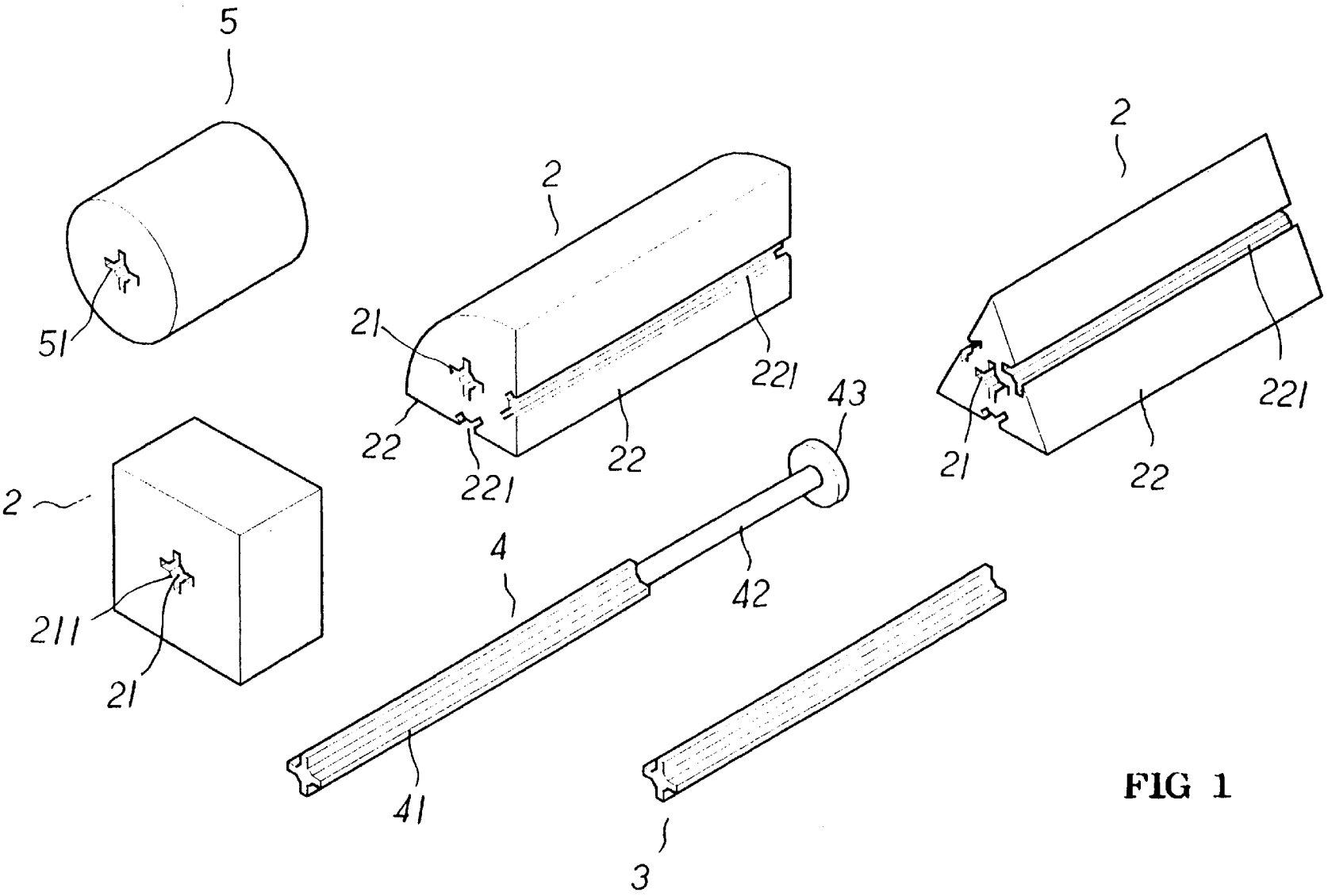
FIG. 1 is a perspective view of a preferred embodiment of the present invention.
Figures 2, 3:
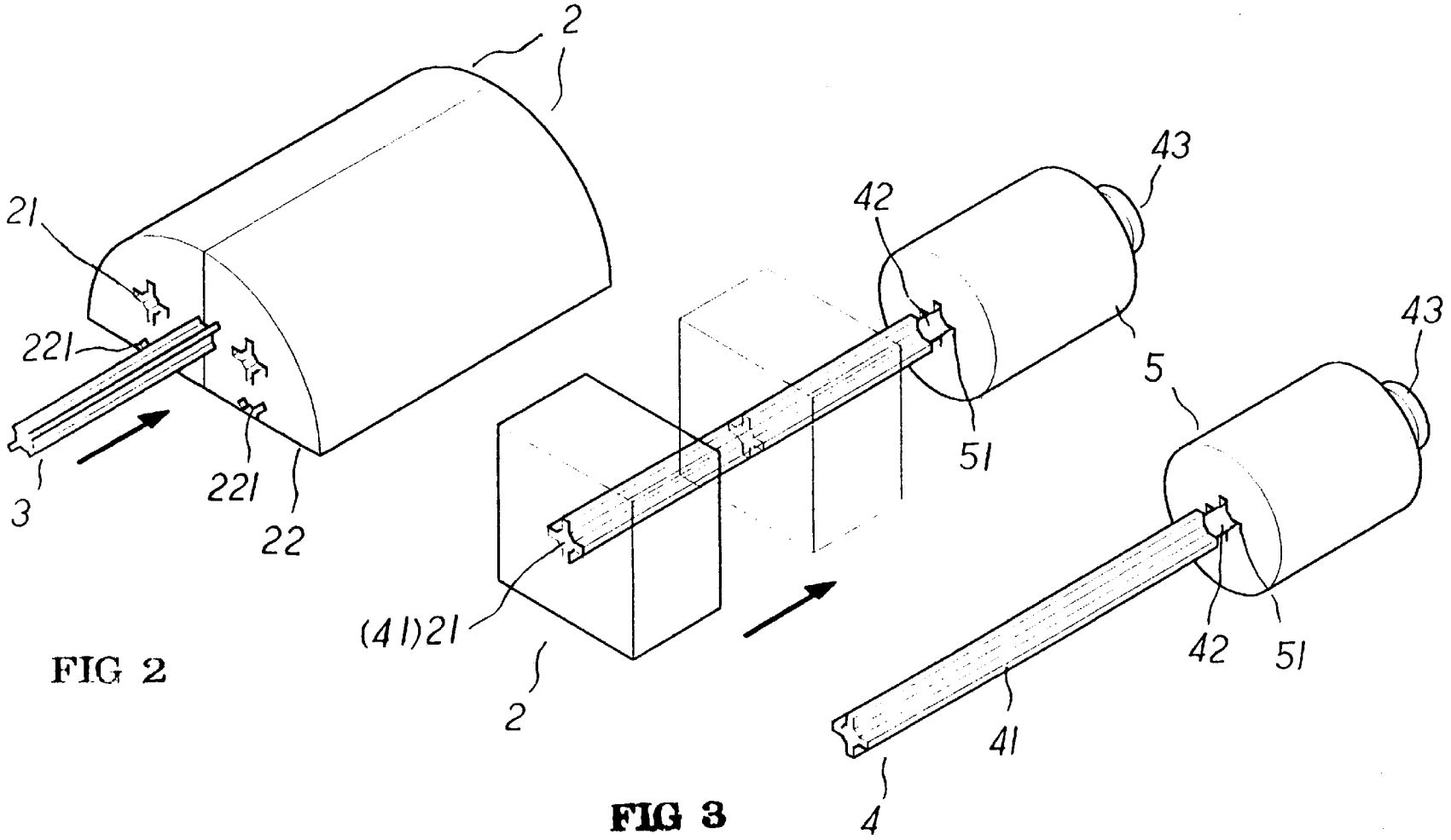
FIG. 2 is a schematic view illustrating an example of assembly of the present invention.
FIG. 3 is a schematic view illustrating another example of assembly of the present invention.

With reference to FIGS. 1 and 2, the present invention comprises a plurality of geometric blocks 2 of various shapes, such as circular, semi-circular, triangular, square, rectangular, etc., a plurality of connecting rods 3 of varying lengths and having a cross-shaped cross section, a plurality of axle rods 4 of varying lengths, a plurality of wheels 5 of different sizes, and a plurality of bases 6. The geometric blocks 2 are each provided with a longitudinal cross-shaped mortise 21 with a small round hole 211 at the center for receiving the connecting rods 3. The longitudinal planar sides 22 of each block 2 are provided with grooves 221 having a substantially V-shaped cross section equivalent to one half of the cross-shaped mortise 21 thereof such that one connecting rod 3 may be used to connect two adjacent blocks 2 when the latter are juxtaposed with their V-shaped grooves defining a complete cross-shaped hole for passage of the connecting rod 3. Each axle rod 4 includes a connecting portion having a cross-shaped cross section, an axle portion 42 of a reduced diameter connected to the connecting portion, and a stop rim 43 at a distal end. Each wheel 5 is centrally provided with a longitudinal receiving hole 51 having a cross-shaped cross section. Each base 6 is provided with a plurality of cross-shaped mortises 61 into which the connecting rods 3 and axle rods 4 may be selectively inserted. In use, the connecting rods 3, which have varying lengths, are inserted through the mortises 21 of selected geometric blocks 2 to connect them in a longitudinal direction or fitted into the grooves 221 of adjacent geometric blocks 2 to connect them in a transverse direction.

Furthermore, the axle rods 4 may be inserted through the receiving holes 51 of the wheels 5 with the stop rim 43 limiting the wheels 5 and further into the mortises 21 of the geometric blocks 2, as shown in FIG. 3, to allow the wheels 5 to rotate smoothly so that the construction can be pushed along by means of the wheels 5.

Figure 4:
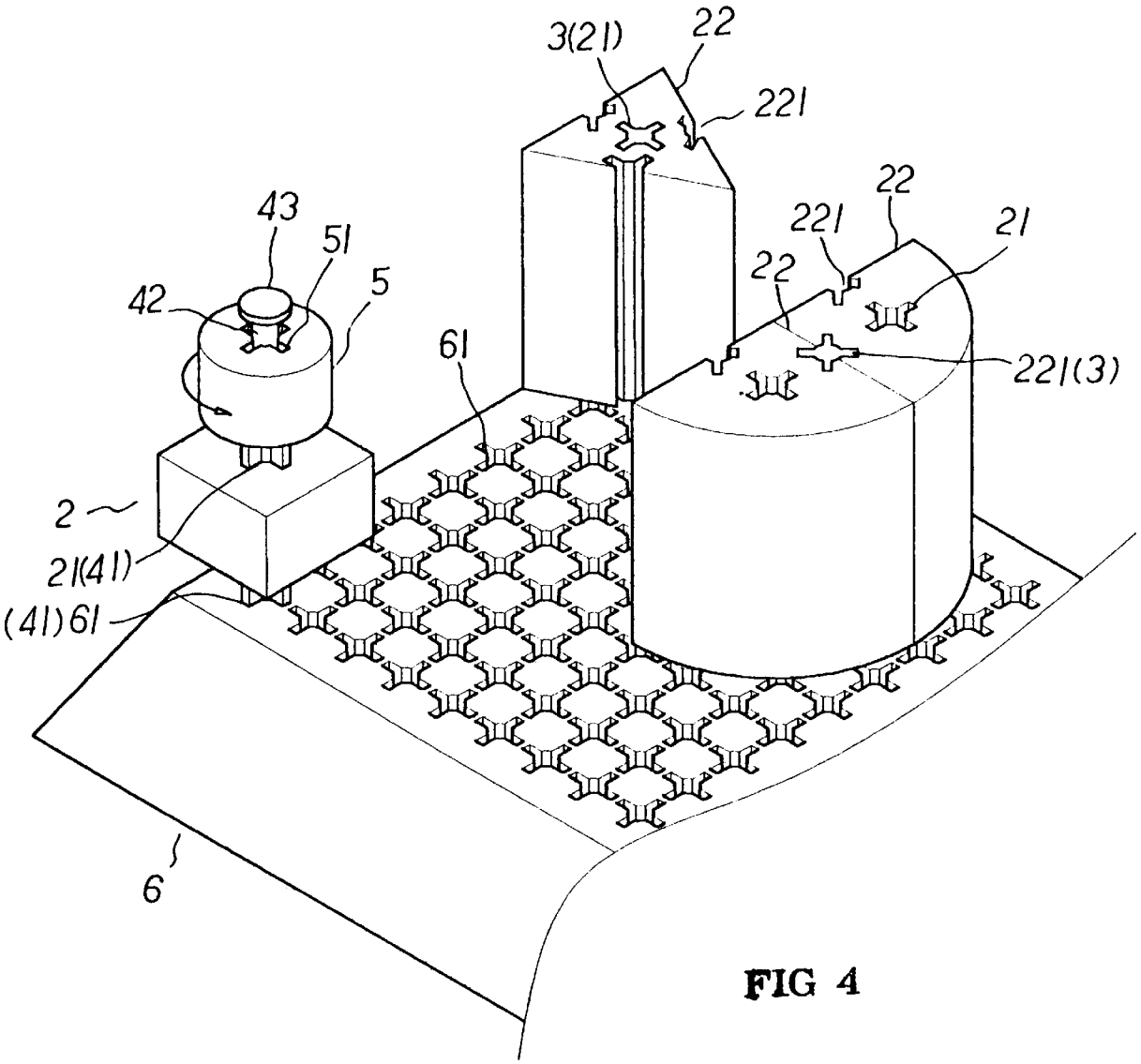
FIG. 4 is a schematic view illustrating use of the present invention with a base.

In addition, the geometric blocks 2 and wheels 5 can be assembled to the bases 6 by means of the connecting rods 3 and axle rods 4, as shown in FIG. 4, to construct a castle, for instance. As the present invention employs connecting rods 3 and axle rods 4 to connect the blocks 2 and wheels 5, the accomplished construction will not easily fall apart, thus helping to sustain children's interest in playing.

Although the present invention has been illustrated and described with reference to the preferred embodiment thereof, it should be understood that it is in no way limited to the details of such embodiment but is capable of numerous modifications within the scope of the appended claims.

What is claimed is:

1. A building block assembly comprising:

a) a plurality of blocks of varying geometric shapes, a plurality of connecting rods of varying lengths and a plurality of axle rods of varying lengths;

b) each block including a longitudinal mortise extending through the block, each mortise being of a cross-shaped configuration and having four interrupted semi-circular arcs lying entirely on an imaginary circle;

c) at least a portion of each connecting and axle rod having a cross-shaped configuration corresponding to each mortise to permit a plurality of blocks to be assembled onto each connecting rod and each axle rod in a longitudinal direction; and d) at least each of two blocks including a longitudinal planar side, each planar side being provided with a groove having a cross-sectional configuration corresponding to one-half the configuration of a mortise, whereby the grooves of two planar surfaces may receive a single connecting rod to secure two blocks together in a transverse direction.

2. The building block assembly of claim 1 further including at least one base, the base including a plurality of cross-shaped mortises corresponding in configuration to the cross-shaped configuration of each connecting and axle rod for selectively receiving the connecting and axle rods and firmly supporting a construction formed from the block assembly.

3. A building block assembly comprising:

a) a plurality of blocks of varying geometric shapes, a plurality of connecting rods of varying lengths and a plurality of axle rods of varying lengths;

b) each block including a longitudinal mortise extending through the block, each mortise being of a cross-shaped configuration having a central round hole;

c) at least a portion of each connecting and axle rod having a cross-shaped configuration corresponding to each mortise to permit a plurality of blocks to be assembled onto each connecting rod and each axle rod in a longitudinal direction;

d) at least each of two blocks including a longitudinal planar side, each planar side being provided with a groove having a cross-sectional configuration corresponding to one-half the configuration of a mortise, whereby the grooves of two planar surfaces may receive a single connecting rod to secure two blocks together in a transverse direction; and e) each axle rod further including an axle portion having a reduced diameter secured to the portion of the axle rod having a cross-shaped configuration, a stop rim at a distal end of the axle portion, at least each of some of the blocks being of a wheel configuration, and each axle rod being insertable through the mortise of each wheel to dispose the wheel on the axle portion and permit the wheel to rotate smoothly about the axle portion and be maintained thereon by the stop rim.

* * * * *